US006220797B1

(12) United States Patent
Ishii et al.

(10) Patent No.: US 6,220,797 B1
(45) Date of Patent: Apr. 24, 2001

(54) SURFACE TREATED STEEL CUTTING TOOL

(75) Inventors: Yoshiro Ishii, Ichikawa; Naoto Kanbara, Yamato, both of (JP)

(73) Assignee: Sumitomo Metal Minning Co., Tokyo (JP)

( * ) Notice: Subject to any disclaimer, the term of this patent is extended or adjusted under 35 U.S.C. 154(b) by 0 days.

(21) Appl. No.: 09/334,092

(22) Filed: Jun. 16, 1999

(30) Foreign Application Priority Data

Jun. 18, 1998 (JP) ..... 10-171913

(51) Int. Cl.[7] ..... B23B 27/14

(52) U.S. Cl. ..... 408/144; 407/119; 428/457; 428/698

(58) Field of Search ..... 407/119; 408/144; 428/457, 698

(56) References Cited

U.S. PATENT DOCUMENTS

| | | | | |
|---|---|---|---|---|
| 4,169,913 | | 10/1979 | Kobayashi et al. . | |
| 4,284,687 | | 8/1981 | Dreyer et al. . | |
| 4,436,830 | | 3/1984 | Andreev et al. . | |
| 4,826,365 | * | 5/1989 | White | 408/144 |
| 4,971,485 | * | 11/1990 | Nomura et al. | 408/144 |
| 5,186,739 | * | 2/1993 | Isobe et al. | 408/144 |
| 5,330,853 | | 7/1994 | Hofmann et al. . | |
| 5,431,072 | * | 7/1995 | Christoffel | 408/144 |
| 5,570,978 | * | 11/1996 | Rees et al. | 408/144 |
| 5,981,049 | * | 11/1999 | Ohara et al. | 428/216 |
| 5,985,427 | * | 11/1999 | Ueda et al. | 428/216 |
| 6,015,614 | * | 1/2000 | Ruppi | 428/698 |
| 6,027,808 | * | 2/2000 | Aoki et al. | 428/698 |
| 6,057,046 | * | 5/2000 | Tsuda et al. | 428/698 |
| 6,071,601 | * | 6/2000 | Oshika et al. | 428/216 |

FOREIGN PATENT DOCUMENTS

| | | | | |
|---|---|---|---|---|
| 3841128 | * | 6/1990 | (DE) | 408/144 |
| 0 592 986 | | 4/1994 | (EP) . | |
| 0184784 | * | 6/1998 | (EP) | 408/144 |
| 0048413 | * | 3/1987 | (JP) | 408/144 |
| 4053616 | | 2/1992 | (JP) . | |
| 5345212 | | 12/1993 | (JP) . | |
| 6-220606 | | 8/1994 | (JP) . | |
| 7-118826 | | 5/1995 | (JP) . | |
| 7-118850 | | 5/1995 | (JP) . | |
| 8-013124 | | 1/1996 | (JP) . | |
| 8-013126 | | 1/1996 | (JP) . | |
| 8-035053 | | 2/1996 | (JP) . | |
| 8-035075 | | 2/1996 | (JP) . | |
| 8-296064 | | 11/1996 | (JP) . | |

* cited by examiner

*Primary Examiner*—A. L. Wellington
*Assistant Examiner*—Monica S. Carter
(74) *Attorney, Agent, or Firm*—Helfgott & Karas, P.C.

(57) ABSTRACT

An inexpensive steel cutting tool with excellent cutting characteristics and cutting life is provided to have a cutting part having a chamfered cutting edge and a surface hardening layer formed therein, wherein surface treatment is performed by forming a sufficiently thick surface hardening layer on the surface of steel base material, or by forming a hard coating film on the surface hardening layer.

23 Claims, 6 Drawing Sheets

SURFACE TREATED STEEL CUTTING TOOL

FIELD OF THE INVENTION

This invention relates to a steel cutting tool which is surface-treated to improve the machinability and tool life.

BACKGROUND OF THE INVENTION

Steel materials, such as high-speed tool steel (Vicker's hardness (HV) of approximately 900) which is tough and whose hardness does not decrease even if the temperature of the steel rises in the 600° C. temperature range, have been used in cutting tools such as turning tools and drills. On the other hand, cemented carbides (HV of approximately 1800), which have superior hardness and resistance to cutting wear since its major component is made from carbides of a metal or metals having a high melting point, have also been used for cutting tools.

Cemented carbide cutting tools made of cemented carbides, are characterized by decreasing the cutting depth while at the same time increasing the cutting speed as much as possible. However, not only are such tools expensive, but they are highly unreliable because they can break suddenly, and therefore applications are limited.

By treating the surface of steel cutting tools made of high-speed tool steel with various surface hardening methods which use gas, plasma, salt baths, etc., a compound layer comprised of iron-nitride, iron-carbide or iron-carbonitride compounds is formed in a few $\mu$m thickness on the top surface of the tool, and a layer (this layer is called the surface-hardening layer below) is formed in a thickness from a few $\mu$m to a few hundred um under that compound layer, where nitrogen and carbon in atomic state are diffused (solid solution) inside the base material for tool. The hardness of the base material is increased by this surface-hardening layer, and thus improves the resistance to cutting wear of the tool. Accordingly, the surface of the cutting edge portion is hardened.

However, the aforementioned compound layer is brittle. Therefore, methods have been used to remove the compound layer after surface treatment, or to perform surface treatment in conditions that do not allow the compound layer to form. However, if the aforementioned compound layer is removed, part of the super-hard surface-hardening layer is also removed. Also, if surface treatment is performed in conditions that do not allow the compound layer to form, the surface-hardening layer formed is not thick enough.

After the surface-hardening layer has been formed on the steel cutting tool by the above method as a pre-treatment, a duplex surface treatment is then performed for forming a hard coating film. To form this hard film, a method such as the PVD method, which has the advantage of being able to form the film at a relatively low temperature, is used, and a single-layer or multi-layer film of TiN, or TiCN, TiAlN, CrN or the like which is harder and more resistant to oxidation than TiN, is formed. Adhesive ability and durability of the hard coating film are improved by this duplex surface treatment.

For steel cutting tools with a hard coating film formed on them in this way, the hard coating film is subject to chipping and flaking, making it impossible to obtain adequate cutting performance. Therefore, it is necessary to form a surface-hardening layer that is hard and thick enough that it is has the same coating film performance as the hard coating film formed on the cemented carbide.

Methods for forming a nitrogen diffusion layer (surface-hardening layer) or hard coating film having sufficient thickness and good controllability and reproducibility, as well as methods for manufacturing tools using these methods are known (see Japanese patent publications Nos. Tokukai Hei 6-220606, 7-118826, 7-118850, 8-13124, 8-13126, 8-35053, 8-35075 and 8-296064). The aforementioned steel cutting tools have a cutting part that is formed with the following layers, (1), (2), (3) and (4).

(1) Nitrogen diffusion layer on the surface of the steel base material, (2) (a) a first layer, which is a nitrogen diffusion layer formed on the surface of the steel base material, and (b) a second layer, which is a hard coating film layer formed on the first layer, and which is made of at least one member selected from the group of nitrides, carbides and carbonitrides of at least one member selected from the group of Ti, Zr, Hf, V, Nb, Ta metals and their alloys. The at least one member selected from the group of nitrides, carbides and carbonitrides of at least one member selected from the group of Ti, Zr, Hf, V, Nb, Ta metals and their alloys is hereafter called MN(C) compound.

(3) (a) a first layer, which is a nitrogen diffusion layer formed on the surface of the steel base material, and (b) a second layer, which is a hard coating film layer formed on the first layer, and which is made of at least one member selected from the group of nitrides, carbides and carbonitrides of a Ti—Al alloy. The at least one member selected from the group of nitrides, carbides and carbonitrides of a Ti—Al alloy is hereafter called TiAlN(C) compound.

(4) (a) a first layer, which is a nitrogen diffusion layer formed on the surface of the steel base material, (b) a second layer, which is an intermediate hard coating film layer formed on the first layer and made of an MN(C) compound, and (c) a third layer, which is a hard coating film layer formed on the second layer and made of a TiAlN(C) compound.

In the case of the cutting tools disclosed in the aforementioned patent publications, the nitrogen diffusion layer increases the hardness of the base material, and suppresses deformation of the base material due to local concentrated stresses. Therefore, it prevents chipping of the base material near the cutting edge, and improves the cutting life of the tool. Moreover, if a hard coating film is formed on the nitrogen diffusion layer, the adherence of the nitrogen diffusion layer with the hard coating film is also improved and thus it is possible to suppress flaking of the hard coating film and make a tool that has superior cutting characteristics as well as resistance to wear. In order to sufficiently take advantage of this action, it is best to not form compounds such as iron-nitrides or iron-carbonitrides.

It is possible to use gas nitriding, gas carbo-nitriding, plasma nitriding, salt-bath nitriding or the like as the nitriding method for forming the nitrogen diffusion layer. If compounds are contained in the formed nitrogen diffusion layer, the compounds can be removed by a method such as grinding.

The hard coating film layer that is formed on the nitrogen diffusion layer has a high HV of 1500 to 3000, and it has a small friction coefficient, so it has very excellent resistance to wear.

In the aforementioned hard coating film layer, TiAlN(C) is a substitution type solid solution in which part of the Ti in one or more B1-type crystal structures selected from the group of Ti nitrides, Ti carbides or Ti carbonitrides (hereafter called TiN(C)) is replaced with Al. Moreover, a tight oxide is formed on the surface of the hard coating film made of TiAlN(C) due to the solid solution Al when exposed in an oxidation atmosphere, and it prevents further oxidation of that oxide. Therefore, it prevents degradation due to oxidation of the coating film due to heat generated during cutting.

If the amount of Al is less than 20 mole %, it is not possible to obtain the above action, and if it exceed 70 mole %, the B1-type crystal structure similar to TiN(C) changes and the mechanical properties of the coating film greatly decrease. Therefore, it is best if the amount of Al is between 20 mole % to 70 mole %.

The TiAlN(C) coating film is not as tough when compared with that of TiN(C), since Al exists as a kind of defect. Therefore, when the base material deforms elastically or plastically, it is unable to follow the deformation and it breaks. However, since a nitrogen diffusion layer is formed, it becomes more difficult for elastic or plastic deformation of the base material to occur, so it is possible to suppress breakage. It is better if the hard coating film made of TiAlN(C) is a multi-layer film although it can be a single-layer film. That is because when the toughness of a multi-layer is improved when compared with a single-layer film, so that it contributes to suppressing breakage. This multi-layer film is defined as (1) a film whose Al content changes gradually in the direction of depth, (2) a film whose Al content changes in the direction of depth not gradually but in stages, or (3) a coexistence of both film (1) and film (2).

If an intermediate hard coating film layer (MN(C)) is formed on the nitrogen diffusion layer, the intermediate hard coating film layer is tougher than the hard coating film layer (TiAlN(C)), so that when compared to the case where there is just a hard coating film layer with no intermediate hard coating film layer, the toughness of the overall hard coating film comprised of the intermediate hard coating film layer and hard coating film layer is improved, and contributes to suppressing breakage.

It is best if the thickness of the intermediate hard coating film layer is 90% or less of the thickness of the overall hard coating film. If it exceeds 90%, the thickness of the hard coating film layer is thin (less than 10%), and it is not possible for the function of the hard coating film layer described above (resistance to wear and oxidation) to occur sufficiently.

In order to form the hard coating film layer, as well as the hard coating film layer and intermediate hard coating film layer, a low-temperature film formation method such as a PVD method is best. This is because, in PVD methods such as ion plating or sputtering, it is possible to form the coating film at temperatures below 650° C., and differing from heat CVD methods in which film is formed at high temperature, none of the Nitrogen diffusion layer is lost due to heat. Moreover, it is possible to produce a coating film that has strong bonding strength effective in improving the resistance to sliding friction wear.

Steel cutting tools, the cutting part of which has been treated with a surface treatment such as described above, and which has a sharp cutting edge, are used in the following cutting conditions; cutting speed: 1 m/min to 200 m/min., depth of cutting: 0.1 mm to 20 mm, and feed: 0.01 mm to 10 mm. If used under these conditions, the steel cutting tool has excellent cutting characteristics.

However, as mentioned above, depending on the operating conditions, wear or chipping of the cutting edge occurs easily, and in the conventional steel cutting tools, there has been the problem that it is not possible to take full advantage of the various strong points of the aforementioned surface treatment.

SUMMARY OF THE INVENTION

An objective of the present invention is, taking the above conditions into consideration, to provide an inexpensive steel cutting tool having excellent cutting characteristics and cutting life, while taking advantage of the various strong points of the aforementioned surface treatment.

DETAILED DESCRIPTION OF PREFERRED EMBODIMENTS OF THE INVENTION

Figure 1:
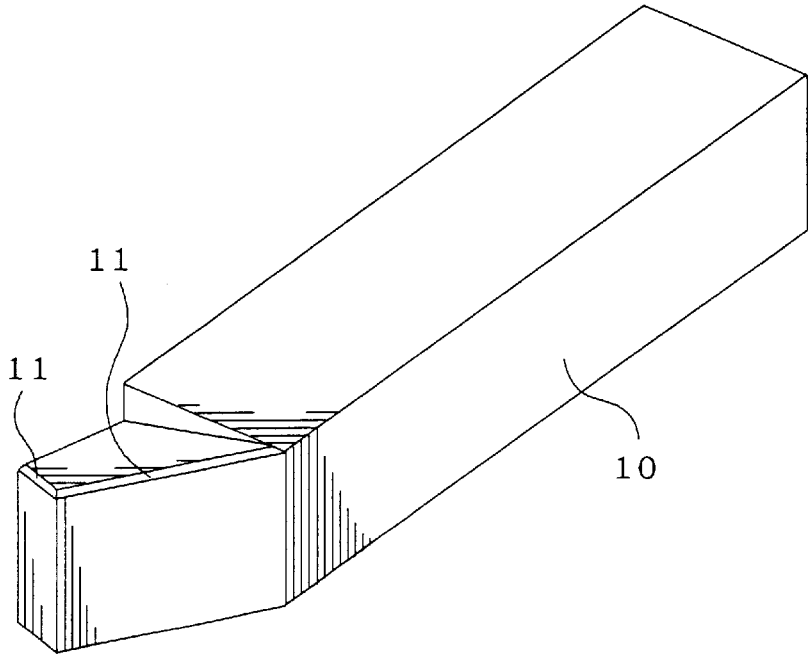
FIG. 1 is a perspective view of a turning tool.

In this invention, in order to accomplish the aforementioned objective, the inventors, based on the results of earnest research, have used a nitrogen diffusion layer, carbon diffusion layer, nitrogen-carbon diffusion layer as the surface hardening surface of the cutting part of the steel cutting tool, and have changed the shape of the cutting edge to make a steel cutting tool that has excellent cutting characteristics and cutting life.

In other words, the surface treated steel cutting tool of this invention is characterized by a surface hardening layer (2 μm thick or more) formed on the cutting part which is made from a nitrogen diffusion layer, carbon diffusion layer or nitrogen-carbon diffusion layer with a hardness of 20 HV or more higher than the base material, retaining the toughness of the base material, and by a cutting edge which is chamfered by an amount of 0.01 mm to 2.0 mm, specifically in a shape of a rounded cutting edge, chamfered cutting edge or chamfered and rounded cutting edge.

The following three elements are required for the cutting tool of this invention (1) The base material is of steel.

(2) The cutting edge portion is surface hardened with a surface hardening layer and (a) with a hard coating film layer formed on the surface hardening layer, and the hard coating film layer being made from at least one member selected from the group of nitrides, carbides and carbonitrides of at least one member selected from the group of Al, Ti, Zr, Hf, V, Nb, Ta and Cr metals and their alloys, or (b) with an intermediate hard coating film layer formed on the surface hardening layer, and with a hard coating film layer formed on the intermediate hard coating film layer, the intermediate hard coating film layer being made from at least one member selected from the group of nitrides, carbides and carbonitrides of at least one member selected from the group of Ti, Zr, Hf, V, Nb, Ta and Cr metals and their alloys, and the hard coating film layer being made from at least one member selected from the group of nitrides, carbides and carbonitrides of a Ti—Al alloy.

(3) The cutting edge is chamfered.

For the surface treated steel cutting tool of this invention, examples of the type of steel that is used are: (1) high-speed tool steel or powder metallurgical high-speed tool steel such as SKH51, SKH55 or SKH57, (2) nitriding steel such as SACM645, (3) steel for hot working such as SKD61, (4) steel for cold working such as SKD11, (5) stainless steel such as SUS420J2, or the like.

Also, examples of the types of cutting tools are: (1) turning tools, (2) threading tools (tap, chaser, etc.), gear cutting tools (hob, pinion cutter, rack cutter, shaving cutter, bevel-gear cutter, gear milling cutter, gear cutting broach, etc., (3) broach, (4) reamer, (5) milling cutter (metal slitting saw, cold circular saw, segmental circular saw, screw slotting cutter, side milling cutter, half side milling cutter, interlocking side milling cutter, angle milling cutter, single-angle milling cutter, unequal double angle milling cutter, double angle milling cutter, form milling cutter, serration milling cutter, concave milling cutter, convex milling cutter, corner rounding milling cutter, double corner rounding milling cutter, involute gear milling cutter, sprocket milling cutter, spline milling cutter, plain milling cutter, slab milling cutter, slotting milling cutter, ball-end mill, radius-end mill, countersink, square end mill, tapered end mill, roughing end mill, roughing and finishing end mill), (6) drill, (7) piercing tool (punch, die), or the like.

For the steel cutting tools of this invention, the fact that the cutting edge is chamfered and, for example, is a rounded cutting edge, chamfered cutting or chamfered and rounded cutting edge (see JIS B 0170) is important.

For a sharp cutting edge the face and flank of which intersect with each other along a line, the performance of the cutting edge drops rapidly due to wear or chipping. Particularly in the case of cutting a material Rockwell hardness © scale (HRC)) between 30 to 40, the cutting edge becomes greatly worn, then in a severe case, the cutting heat rapidly increases, so that seizure is caused between the cutting tool and the material being cut. If the rake angle is decreased in order to delay wear of the cutting edge, the cutting part becomes greatly worn. Also, if the rake angle is greatly decreased, the cutting depth becomes shallow as in the case of cemented carbide tools.

The width of the chamfered cutting edge is defined as the linear distance between the intersection of the face and cutting edge, and the flank and cutting edge, and is properly selected within the range 0.01 mm to 2.0 mm. The following widths are best for the respective tools: (1) turning tools, 0.03 mm to 0.7 mm, (2) tap, hob, metal slitting saw, side milling cutter, plain milling cutter, 0.03 mm to 0.8 mm (the side cutting edge of the side milling cutter should be 0.3 mm or less), (3) broach, 0.03 mm to 0.85 mm, (4) reamer, ball end mill, radius end mill, chamfering end mill, square end mill, tapered end mill, roughing end mill, roughing and finishing end mill, end mill with nicked teeth, 0.01 mm to 0.8 mm (the peripheral cutting edge should be 0.5 or less, and the leading cutting edge and end cutting edge should be 0.05 mm or more), (5) drill, 0.03 mm to 1.5 mm (the leading edge should be 0.3 mm or less), and (6) punch, die, 0.01 mm to 2.0 mm. At widths less than the lower limit the cutting edge becomes the same as a sharp cutting edge and the cutting life is decreased. On the other hand, at widths greater than the upper limit, a cutting edge cannot be established, and the cutting characteristics become poor.

For the cutting tools of this invention, the cutting edge has been beveled and the surface of the steel tool material has undergone suitable surface treatment. Therefore, the following three layers (1), (2) and (3) are formed on the cutting part.

(1) A nitrogen diffusion layer, carbon diffusion layer or nitrogen-carbon diffusion layer on the surface of the steel base material, (2) (a) A first layer, which is a nitrogen diffusion layer, carbon diffusion layer or nitrogen-carbon diffusion layer on the surface of the steel base material, and (b) a second layer, which is a hard coating film layer formed on the first layer, and which is made of one or more members selected from the group of nitrides, carbides and carbonitrides of at least one member selected from the group of Al, Ti, Zr, Hf, V, Nb, Ta, and Cr metals and their alloys, and (3) (a) A first layer, which is a nitrogen diffusion layer, carbon diffusion layer or nitrogen-carbon diffusion layer on the surface of the steel base material, (b) a second layer, which is an intermediate hard coating film layer formed on the first layer and made of an MN(C) compound, and (c) a third layer, which is a hard coating film layer formed on the second layer and made of a TiAlN(C) compound.

The nitrogen diffusion layer can be formed as the surface hardening layer by a method such as disclosed in the patent publications mentioned above, also in the case of forming a carbon diffusion layer or nitrogen-carbon diffusion layer, they can be formed by a well known method similar to that for forming the nitrogen diffusion layer. The hardness of the surface hardening layer is best if it is between Hv700 to Hv1300, or Hv20 more than the base material, in order to prevent the cutting part from becoming dull.

The hard coating film layer can be formed on the surface hardening layer by a method such as disclosed in the patent publications mentioned above.

The thickness of the formed surface hardening material should be properly selected from within a range 2 μm in to 320 μm. The following widths are best for the respective tools: (1) turning tools, broach, 2 μm to 150 μm, (2) tap, 2 μm to 190 um, (3) hob, side milling cutter, ball end mill, radius end mill, chamfering end mill, 2 μm to 280 μm, (4) reamer, 2 μm to 250 μm, (5) metal slitting saw, 2 μm to 180 μm, (6) plain milling cutter, 2 μm to 300 μm, (7) drill, 2 μm to 320 μm, (8) square end mill, tapered end mill, roughing end mill, roughing and finishing end mill, and end mill with nicked teeth, 2 μm to 220 μm, and (9) punch, die, 2 μm to 500 μm. At widths less than the lower limit, the surface hardening layer does not function sufficiently. On the other hand, at widths greater than the upper limit, the base material becomes too hard, and its shock resistance and durability decrease.

Figure 2:
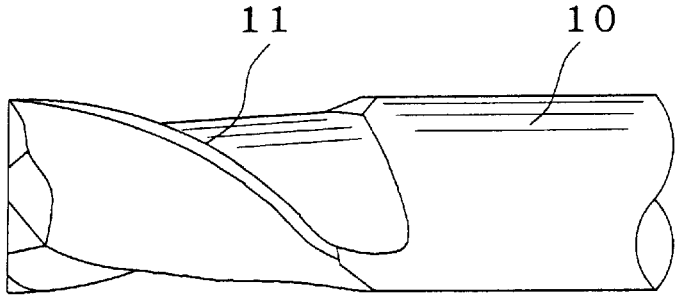
FIG. 2 is a front elevational view of an end mill.
Figure 3:
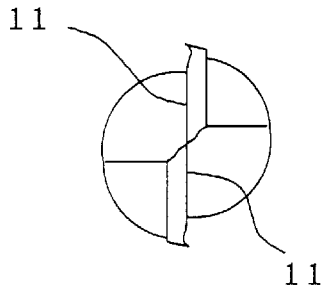
FIG. 3 is a side elevational view of the cutting edge shown in FIG. 2.
Figure 4:
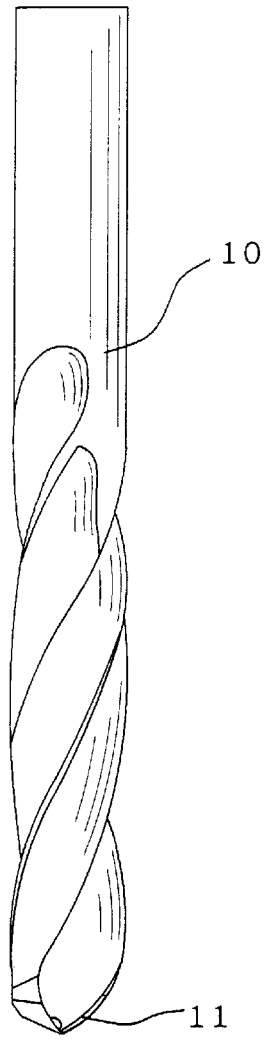
FIG. 4 is a front elevational view of a drill.
Figure 5:
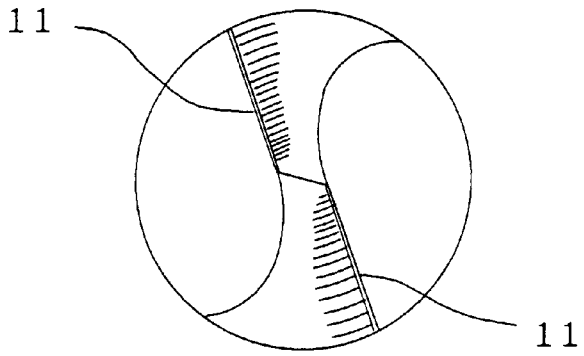
FIG. 5 is a side elevational view of the cutting edge shown in FIG. 4.
Figure 6:
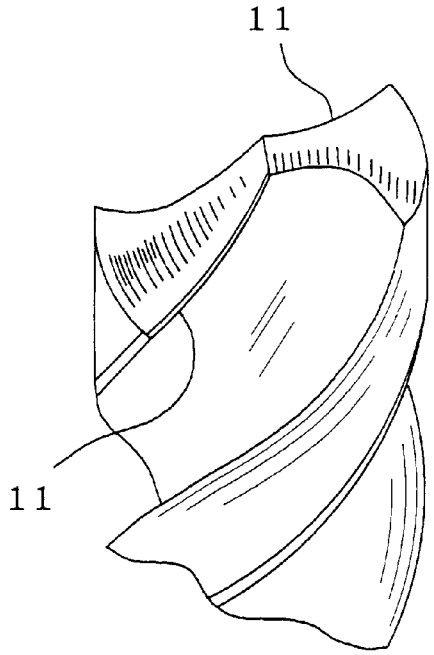
FIG. 6 is a perspective view of the cutting edge shown in FIG. 4.
Figure 7:
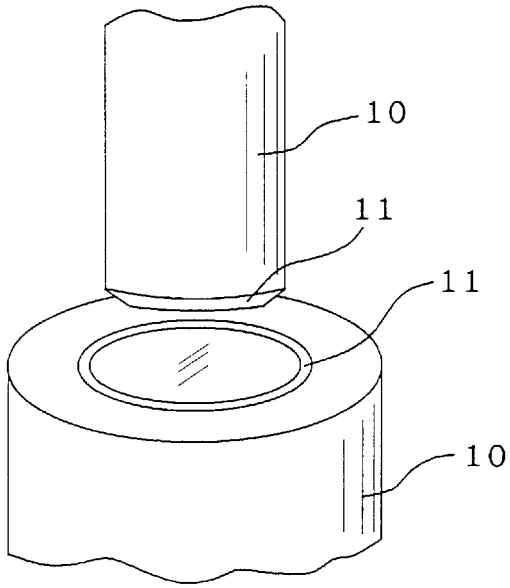
FIG. 7 is a perspective view of a punch and die.
Figure 8:
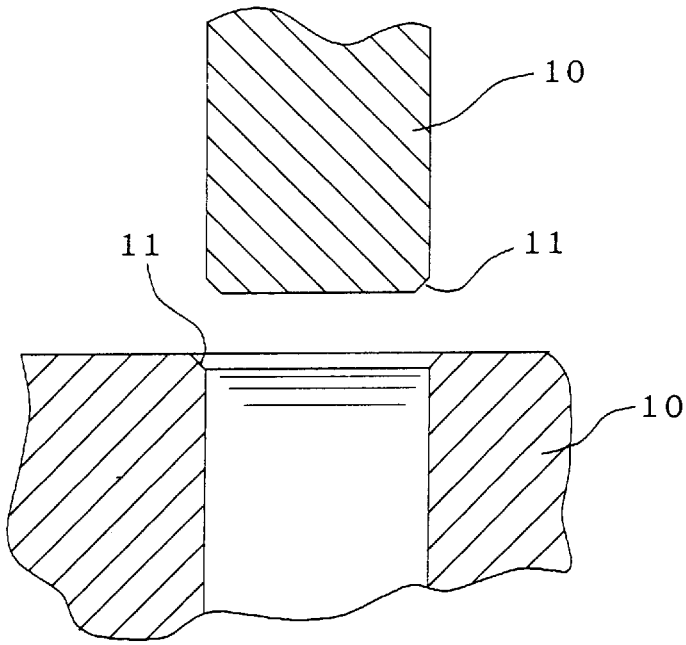
FIG. 8 is a cross sectional view of FIG. 7.
Figure 9:
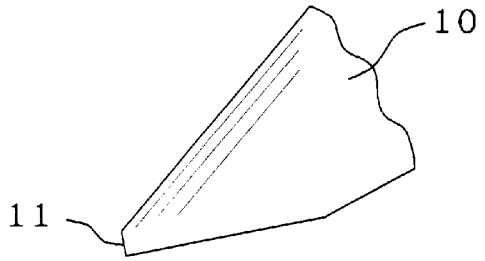
FIG. 9 is a diametrical view of the shape of the cutting edge of a cutting tool according to the present invention.
Figure 10:
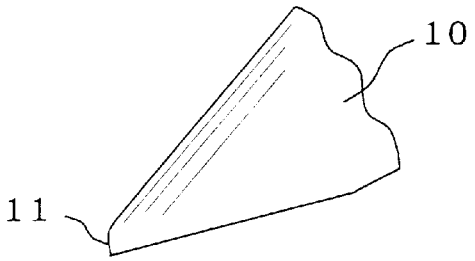
FIG. 10 is a diametrical view of the shape of the cutting edge of another cutting tool according to the present invention.
Figure 11:
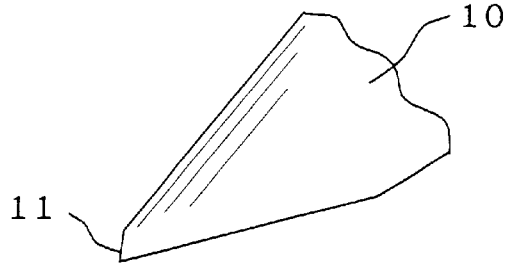
FIG. 11 is a diametrical view of the shape of the cutting edge of another cutting tool according to the present invention.
Figure 12:
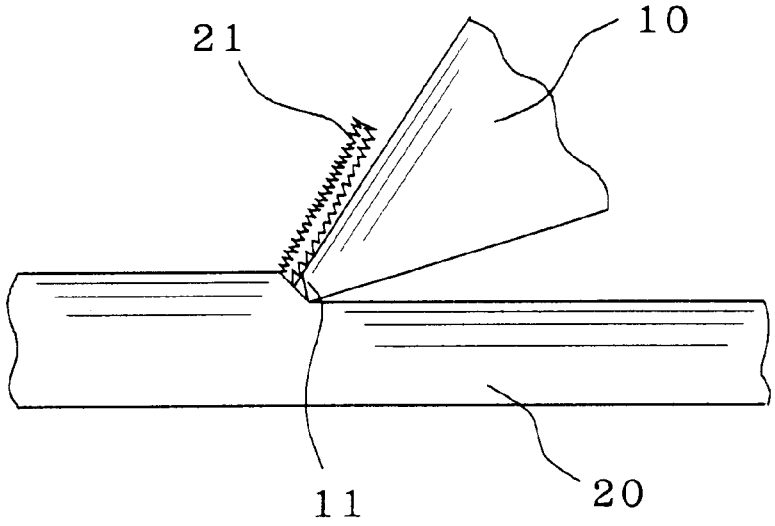
FIG. 12 is a front elevational view of a cutting tool according to the present invention to show the basic cutting condition.

A few examples of the cutting tools having a chamfered cutting edge (the surface of the cutting edge is indicated as 11) of this invention are shown in FIGS. 1 thru 8. FIG. 1 is an isometric view of a turning tool. FIG. 2 is the front view of an end mill, and FIG. 3 is the side view of the side of the cutting edge shown in FIG. 2. Moreover, FIG. 4 is the front view of a drill, and FIG. 5 is the side view of the side of the cutting edge shown in FIG. 4, while FIG. 6 is an isometric view of the cutting edge shown in FIG. 4. Furthermore, FIG. 7 is an isometric view of a punch and die, and FIG. 8 is a cross-sectional view of FIG. 7. Also, FIG. 9, FIG. 10 and FIG. 11 are concept views which show the shape of the cutting edge of the cutting tools of this invention. FIG. 12 is a front view (the tool is indicated as 10, the cut material is indicated as 20, and the chips are indicated as 21) showing the basic cutting conditions of the cutting tools of this invention. Since the cutting tool is chamfered, the shape of the chips is different than those from a sharp cutting edge.

The following are examples of the present invention.

EXAMPLE 1

By using a straight drill (drill of this invention) made of high-speed tool steel (SKH55) having a rounded cutting edge, the cutting part of which was surface treated, a hole drilling test with HRC 30 pre-hardened steel was performed. Also, as a comparison, another straight drill (comparison drill) identical to the above drill but with a sharp cutting edge was used, and the same hole drilling test was performed.

The drills used had a diameter of 12 mm, and the width of the rounded cutting edge was 0.3 mm. Also, in the aforementioned surface treatment, a 120 $\mu$m thick nitrogen diffusion layer was formed by ion nitriding process using direct current plasma of hydrogen gas and ammonia gas, then on top of that nitrogen diffusion layer, a 3 $\mu$m thick TiN hard coating film was formed by cathode arc discharge type ion plating. Compounds, such as iron nitrides or iron carbonitrides, were not observed in any of the nitrogen diffusion layers on the cutting edges. Also, the hole conditions in the hole drilling test were: (1) hole depth: 40 mm, (2) cutting agent: water soluble, (3) drill rpm: 390 rpm (drill of this invention), 230 rpm (comparison drill), (4) time to drill one hole: 0.5 min. (drill of this invention), 0.7 min. (comparison drill).

As results of the hole drilling test, the number of holes drilled by the drill of this invention was 40 holes, and by the comparison drill was 15 holes. The drill of this invention had much better life characteristics when compared with the comparison drill.

EXAMPLES 2 to 12

Cutting process tests of HRC30 die steel were performed with cutting tools made of high-speed tool steel which had a rounded cutting edge the cutting part of which was surface treated. As the reference to obtain the cutting life (ratio), cutting tools made of high-speed tool steel identical to those mentioned above except for having sharp cutting edges, were used and the same cutting process tests as above were performed.

The type, material quality (JIS), dimensions and rounded cutting edge width of the cutting tools made of high-speed tool steel that were used are shown in Table 1. Also, the cutting conditions of the cutting process tests are as given in Table 2.

Of the cutting edge widths shown in Table 1, the cutting edges for the cutting tools are as shown below. Or in other words, (1) the tap (Example 3) and reamer (Example 6) are leading cutting edges, (2) the metal slitting saw (Example 7) and plain milling cutter (Example 9) are peripheral cutting edges, (3) the side milling cutter (Example 8) and square end mill (Example 12) are end cutting edges, and (4) the ball end mill (Example 10) is a ball-shaped end cutting edge. Also, in the aforementioned surface treatment, the nitrogen diffusion layer was formed by ion nitriding process using a direct current plasma of hydrogen gas and ammonia gas.

Compounds such as iron-nitrides or iron-carbonitrides were not observed in any of the nitrogen layers on the aforementioned cutting edges. Also, the thicknesses of the nitrogen diffusion layers were as shown in Table 1.

As a result of the cutting process tests, any damage due to chipping to the cutting part was hardly seen in any of the cutting tools for Examples 2 thru 12, and as shown in Table 3, the tools had very excellent life characteristics (scale factor) when compared with the cutting tools used for comparison. On the other hand, the cutting tools used for the comparison exhibited severe damages at the cutting part due to chipping. The life characteristics (scale factors) shown in Table 3 are for the same cutting edges shown in Table 1.

[TABLE 1]

| | tool | material (SKH) | diameter (mm) | size edge length (mm) | width of cutting edge (mm) | thickness of nitrogen diffusion layer ($\mu$m) |
|---|---|---|---|---|---|---|
| Ex.2 | turning tool | 51 | — | 30 | 0.25 | 50 |
| Ex.3 | tap | 57 | 8 | 100 | 0.2 | 50 |
| Ex.4 | hob | 57 | 180 | 80 | 0.2 | 150 |
| Ex.5 | broach | 51 | 15 (finishing cutting edge) | 250 | 0.2 | 40 |
| Ex.6 | reamer | 57 | 9 | 100 | 0.2 | 90 |
| Ex.7 | metal saw | 51 | 200 | 2(width) | 0.2 | 50 |
| Ex.8 | side milling -cutter | 57 | 150 | 200 | 0.2 | 80 |
| Ex.9 | plain milling -cutter | 51 | 120 | 150 | 0.15 | 100 |
| Ex.10 | ball end mill | 57 | 20 | 180 | 0.2 | 80 |
| Ex.11 | straight drill | 51 | 13 | 250 | 0.3 | 120 |
| Ex.12 | square end mill | 57 | 20 | 250 | 0.2 | 70 |

[TABLE 2]

| | tool | cutting conditions | | |
|---|---|---|---|---|
| Ex.2 | turning tool | cutting speed | depth of cutting | feed |
| | | 60 m/min | 1 mm | 0.5 mm |

[TABLE 2]-continued

| | tool | cutting conditions | | |
|---|---|---|---|---|
| Ex.3 | tap | cutting speed<br>6 m/min | | |
| Ex.4 | hob | cutting speed<br>50 m/min | feed<br>2 mm/rev | |
| Ex.5 | broach | .<br>5 m/min | cutting speed | |
| Ex.6 | reamer | .<br>4 m/min | cutting speed<br>0.5 mm/min | feed |
| Ex.7 | metal saw | cutting speed<br>20 m/min | feed<br>0.4 mm/min | |
| Ex.8 | side milling cutter | cutting speed<br>10 m/min | amount of feed<br>0.03 mm/cutter | |
| Ex.9 | plain milling cutter | cutting speed<br>10 m/min | amount of feed<br>0.03 mm/cutter | |
| Ex.10 | ball end mill | rolling speed<br>800 rpm | depth of cutting<br>0.3 mm | feed<br>300 mm/min |
| Ex.11 | straight drill | cutting speed<br>15 m/min | amount of feed<br>0.3 mm/rev | |
| Ex.12 | square end mill | cutting speed<br>12 m/min | amount of feed<br>0.3 mm/rev | |

[TABLE 3]

| | tool | cutting process test | |
|---|---|---|---|
| | | type | life (times) |
| Ex.2 | turning tool | life in lathe | 1.4 |
| Ex.3 | tap | number of threading | 2.2 |
| Ex.4 | hob | cutting life | 1.5 |
| Ex.5 | broach | cutting life | 1.5 |
| Ex.6 | reamer | number of piercing | 1.7 |
| Ex.7 | metal saw | cutting life | 1.5 |
| Ex.8 | side milling cutter | cutting life | 1.9 |
| Ex.9 | plain milling cutter | cutting life | 1.7 |
| Ex.10 | ball end mill | cutting life | 1.8 |
| Ex.11 | straight drill | number of piercing | 2.5 |
| Ex.12 | square end mill | groove cutting life | 1.7 |

EXAMPLES 13 to 23

Cutting process tests of HRC32 prehardened steel were performed with cutting tools made of high-speed tool steel which had a rounded cutting edge the cutting part of which was surface treated. As the reference to obtain the cutting life (ratio), cutting tools made of high-speed tool steel identical to those mentioned above except for having sharp cutting edges, were used and the same cutting process tests as above were performed.

The type, material quality (JIS), dimensions and rounded cutting edge width of the cutting tools made of high-speed tool steel that were used are shown in Table 4. Also, the cutting conditions of the cutting process tests are as given in Table 5.

Of the cutting edge widths shown in Table 4, the cutting edges for the cutting tools are as shown below. Or in other words, (1) tap (Example 14), hob (Example 15) and reamer (Example 17) are leading cutting edges, (2) the metal slitting saw (Example 18) and plain milling cutter (Example 20) are peripheral cutting edges, (3) side milling cutter (Example 19) and square end mill (Example 23) are end cutting edges, and (4) the ball end mill (Example 21) is a ball-shaped end cutting edge. Moreover, for the end cutting edge of the square-end mill (Example 23), the radial rake of the first face is 0 degrees, the radial rake of the second face is 45 degrees, and the width of the end cutting edge is the distance between the first face and flank. Also, in the aforementioned surface treatment, after forming the nitrogen diffusion layer by ion nitriding process using a direct current plasma of hydrogen gas and ammonia gas, a hard coating film, having the components shown in Table 4, was formed on top of the nitrogen diffusion layer by cathode arc discharge type ion plating.

Compounds such as iron-nitrides or iron-carbonitrides were not observed in any of the nitrogen layers on the aforementioned cutting edges. Also, the thicknesses of the nitrogen diffusion layers were as shown in Table 4. Furthermore, the thickness of the hard coating film was 3 $\mu$m in all cases.

As a result of the cutting process tests, any damage due to chipping in the cutting part was hardly seen in any of the cutting tools for examples 13 thru 23, and as shown in Table 6, the tools had very excellent life characteristics (scale factor) when compared with the cutting tools used for comparison. On the other hand, the cutting tools used for the comparison exhibited severe damages at the cutting part due to chipping. The life characteristics (scale factors) shown in Table 6 are for the same cutting edges shown in Table 4.

[TABLE 4]

| | tool | material (SKH) | size | | | | |
|---|---|---|---|---|---|---|---|
| | | | diameter (mm) | edge length (mm) | width of cutting edge (mm) | thickness of nitrogen diffusion layer ($\mu$m) | |
| Ex.13 | turning tool | 51 | — | 30 | 0.2 | 40 | TiAlN |
| Ex.14 | tap | 57 | 7 | 90 | 0.15 | 30 | TiCN |
| Ex.15 | hob | 57 | 120 | 60 | 0.25 | 120 | TiN |
| Ex.16 | broach | 51 | 18<br>(finishing cutting edge) | 300 | 0.2 | 30 | TiCN |
| Ex.17 | reamer | 57 | 8 | 90 | 0.15 | 50 | TiN |
| Ex.18 | metal saw | 51 | 300 | 2(width) | 0.15 | 40 | CrN |
| Ex.19 | side milling -cutter | 57 | 150 | 200 | 0.15 | 50 | TiCN |
| Ex.20 | plain milling -cutter | 51 | 120 | 150 | 0.2 | 90 | CrN |
| Ex.21 | ball end mill | 57 | 20 | 180 | 0.2 | 80 | TiN |

[TABLE 4]-continued

| | tool | material (SKH) | diameter (mm) | size: edge length (mm) | size: width of cutting edge (mm) | thickness of nitrogen diffusion layer (μm) | |
|---|---|---|---|---|---|---|---|
| Ex.22 | straight drill | 51 | 18 | 300 | 0.2 | 80 | TiCN |
| Ex.23 | square end mill | 57 | 10 | 100 | 0.2 | 120 | TiN |

[TABLE 5]

| | tool | cutting conditions | | |
|---|---|---|---|---|
| Ex.13 | turning tool | cutting speed 90 m/min | depth of cutting 1 mm | feed 0.8 mm |
| Ex.14 | tap | cutting speed 8 m/min | | |
| Ex.15 | hob | cutting speed 70 m/min | feed 3 mm/rev | |
| Ex.16 | broach | cutting speed 7 m/min | | |
| Ex.17 | reamer | cutting speed 5 m/min | feed 0.7 mm/min | |
| Ex.18 | metal saw | cutting speed 35 m/min | feed 0.6 mm/min | |
| Ex.19 | side milling cutter | cutting speed 15 m/min | amount of feed 0.06 mm/cutter | |
| Ex.20 | plain milling cutter | cutting speed 15 m/min | amount of feed 0.06 mm/cutter | |
| Ex.21 | ball end mill | rolling speed 900 rpm | depth of cutting 0.3 mm | feed 400 mm/min |
| Ex.22 | straight drill | cutting speed 20 m/min | amount of feed 0.5 mm/rev | |
| Ex.23 | square end mill | cutting speed 18 m/min | amount of feed 0.5 mm/rev | |

[TABLE 6]

| | tool | cutting process test: type | cutting process test: life (times) |
|---|---|---|---|
| Ex.2 | turning tool | life of process | 2.1 |
| Ex.3 | tap | Number of threading | 3.0 |
| Ex.4 | hob | cutting life | 2.0 |
| Ex.5 | broach | cutting life | 1.7 |
| Ex.6 | reamer | Number of piercing | 2.3 |
| Ex.7 | metal saw | cutting life | 2.0 |
| Ex.8 | side milling cutter | cutting life | 2.1 |
| Ex.9 | plain milling cutter | cutting life | 2.5 |
| Ex.10 | ball end mill | cutting life | 2.5 |
| Ex.11 | straight drill | Number of piercing | 1.8 |
| Ex.12 | square end mill | groove cutting life | 2.5 |

The present invention, constructed as described above, takes advantage of the strong points of surface treatment by forming a sufficiently thick surface hardening layer on the surface of the tool, or by forming a hard coating film on the surface hardening layer, making it possible to provide inexpensive steel cutting tools with excellent cutting characteristics and cutting life.

What is claimed is:

1. A surface treated steel cutting tool made from a base material and comprising a cutting part having a chamfered cutting edge and formed with a surface hardening layer, and (a) with a hard coating film layer formed on the surface hardening layer, and the hard coating film layer being made from at least one member selected from the group of nitrides, carbides and carbonitrides of at least one member selected from the group of Al, Ti, Zr, Hf, V, Nb, Ta and Cr metals and their alloys, or (b) with an intermediate hard coating film layer formed on the surface hardening layer, and with a hard coating film layer formed on the intermediate hard coating film layer, the intermediate hard coating film layer being made from at least one member selected from the group of nitrides, carbides and carbonitrides of at least one member selected from the group of Ti, Zr, Hf, V, Nb, Ta and Cr metals and their alloys, and the hard coating film layer being made from at least one member selected from the group of nitrides, carbides and carbonitrides of a Ti—Al alloy.

2. The surface treated steel cutting tool of claim 1, wherein the base material is high-speed tool steel.

3. The surface treated steel cutting tool of claim 1, wherein the base material is one selected from the group of high-speed tool steel, powder metallurgical high-speed tool steel, nitriding steel, steel for hot-working, steel for cold-working, and stainless steel.

4. The surface treated steel cutting tool of claim 1, wherein the cutting edge is one of a rounded cutting edge, chamfered cutting edge and chamfered and rounded cutting edge.

5. The surface treated steel cutting tool of claim 1, wherein the surface hardening layer is one of a nitrogen diffusion layer, carbon diffusion layer and nitrogen-carbon diffusion layer.

6. The surface treated steel cutting tool of claim 1, wherein the cutting tool is one of a turning tool, threading tool, gear cutting tool, broach, reamer, milling cutter, drill and piercing tool.

7. The surface treated steel cutting tool of claim 1, wherein the cutting tool is a turning tool the cutting edge of which has a width in the range of 0.03 mm to 0.7 mm.

8. The surface treated steel cutting tool of claim 1, wherein the cutting tool is one of a tap, hob, metal slitting saw, side milling cutter and plain milling cutter the cutting edge of which has a width in the range of 0.03 mm to 0.8 mm.

9. The surface treated steel cutting tool of claim 1, wherein the cutting tool is a broach the cutting edge of which has a width in the range of 0.03 mm to 0.85 mm.

10. The surface treated steel cutting tool of claim 1, wherein the cutting tool is one of a reamer, ball end mill, radus end mill, chamfering end mill, square end mill, tapered end mill, roughing end mill, roughing and finishing end mill, and end mill with nicked teeth the cutting edge of which has a width in the range of 0.01 mm to 0.8 mm.

11. The surface treated steel cutting tool of claim 1, wherein the cutting tool is a drill the cutting edge of which has a width in the range of 0.03 mm to 1.5 mm.

12. The surface treated steel cutting tool of claim 1, wherein the cutting tool is one of a punch and die the cutting edge of which has a width in the range of 0.01 mm to 2.0 mm.

13. The surface treated steel cutting tool of claim 1, wherein the cutting tool is one of a turning tool and broach the surface hardening layer of which has a thickness in the range of 2 μm to 150 μm.

14. The surface treated steel cutting tool of claim 1, wherein the cutting tool is a tap the surface hardening layer of which has a thickness in the range of 2 μm to 190 μm.

15. The surface treated steel cutting tool of claim 1, wherein the cutting tool is one of a hob, side milling cutter, ball end mill, radus end mill and chamfering end mill the surface hardening layer of which has a thickness in the range of 2 μm to 280 μm.

16. The surface treated steel cutting tool of claim 1, wherein the cutting tool is a reamer the surface hardening layer of which has a thickness in the range of 2 μm to 250 μm.

17. The surface treated steel cutting tool of claim 1, wherein the cutting tool is a metal slitting saw the surface hardening layer of which has a thickness in the range of 2 μm to 180 μm.

18. The surface treated steel cutting tool of claim 1, wherein the cutting tool is a plain milling cutter the surface hardening layer of which has a thickness in the range of 2 μm to 300 μm.

19. The surface treated steel cutting tool of claim 1, wherein the cutting tool is a drill the surface hardening layer of which has a thickness in the range of 2 μm to 320 μm.

20. The surface treated steel cutting tool of claim 1, wherein the cutting tool is one of a square end mill, tapered end mill, roughing end mill, roughing and finishing end mill and end mill with nicked teeth the surface hardening layer of which has a thickness in the range of 2 μm to 220 μm.

21. The surface treated steel cutting tool of claim 1, wherein the cutting tool is one of a punch and die the surface hardening layer of which has a thickness in the range of 2 μm to 500 μm.

22. The surface treated steel cutting tool of claim 1 wherein the cutting tool is is adapted for a cutting speed from 1 m/min to 800 m/min, the depth of cut from 0.01 mm to 50 mm, and the feed from 0.01 mm to 30 mm.

23. A surface treated steel cutting tool made from a base material and comprising a cutting part having a chamfered cutting edge and formed with a surface hardening layer, and with an intermediate hard coating film layer formed on the surface hardening layer, and with a hard coating film layer formed on the intermediate hard coating film layer, the intermediate hard coating film layer being made from at least one member selected from the group of nitrides, carbides and carbonitrides of at least one member selected from the group of Ti, Zr, Hf, V, Nb, Ta and Cr metals and their alloys, and the hard coating film layer being made from at least one member selected from the group of nitrides, carbides and carbonitrides of a Ti—Al alloy.

* * * * *